US005857348A

United States Patent [19]

Conry

[11] Patent Number: 5,857,348

[45] Date of Patent: Jan. 12, 1999

[54] COMPRESSOR

[75] Inventor: Ronald David Conry, Melbourne, Australia

[73] Assignee: Multistack International Limited, Boronia, Australia

[21] Appl. No.: 578,563

[22] PCT Filed: Jun. 14, 1994

[86] PCT No.: PCT/AU94/00319

§ 371 Date: Mar. 8, 1996

§ 102(e) Date: Mar. 8, 1996

[87] PCT Pub. No.: WO94/29597

PCT Pub. Date: Dec. 22, 1994

[30] Foreign Application Priority Data

Jun. 15, 1993 [AU] Australia ..... PL9394

[51] Int. Cl.[6] ..... F25B 41/04; F04B 17/00

[52] U.S. Cl. ..... 62/209; 62/217; 62/228.5; 62/508; 417/423.12

[58] Field of Search ..... 310/90.5; 417/423.14, 417/423.12; 62/217, 508, 228.5, 209, 505

[56] References Cited

U.S. PATENT DOCUMENTS

| | | | |
|---|---|---|---|
| 4,616,483 | 10/1986 | Leonard | 62/228.5 X |
| 5,142,175 | 8/1992 | Watanabe | 310/90.5 |
| 5,336,064 | 8/1994 | Lamers | 417/423.17 X |
| 5,537,830 | 7/1996 | Goshaw et al. | 62/417 X |

*Primary Examiner*—William Wayner
*Attorney, Agent, or Firm*—Dvorak & Orum

[57] ABSTRACT

A centrifugal type refrigerant compressor comprises at least one impeller (17, 18), electric motor (27) and drive shaft (22) mounted on non-lubricated radial bearings, such as magnetic or foil gas bearings (23, 24), with axial locating means (26) associated with the shaft (22) to restrict axial movement thereof with respect to the compressor housing (12). The housing (12) encases the motor (27) and the compressor and defines the gas inlet (31) and the gas outlet (16) passageways. Gas throttling means (34) is provided in the inlet (31), and a control means (30) varies the speed of the motor (27) and the throttling means (34) to control the compression ratio and mass flow through the compressor in accordance with the refrigeration load.

31 Claims, 7 Drawing Sheets

COMPRESSOR

FIELD OF THE INVENTION

This invention relates to a compressor and relates particularly to a compressor for use in refrigeration systems, environment control systems, air conditioning systems and the like. For convenience, the invention will be described with particular reference to air conditioning systems.

Air conditioning systems utilize compressors of varying sizes ranging from the very smaller compressors used in motor vehicles and domestic situations to the commercial air conditioning equipment having compressors ranging up to hundreds of Ton capacity.

BACKGROUND OF THE INVENTION

Gas compressors such as those used in air conditioning and like systems use oil or alternatives as a lubricant for the compressor bearings. Because lubricating oils have an affinity with and absorb the refrigerants in which they operate, they should ideally be kept at an elevated temperature even when the compressor is not operating to prevent the refrigerant condensing in the oil. Such condensed refrigerant causes oil to foam on initial starting of a compressor, ultimately leading to compressor failure.

Further, up until now it has been necessary to design the refrigeration circuit of an air conditioning system to ensure that any oil which travels through the system can be returned to the compressor. Because it is difficult to restrict or prevent the oil travelling through the entire refrigeration system, oil traps need to be placed and oil return has to be taken into account when the system is designed. This causes restrictions such as the need to limit equipment location, the length of pipe run, the size of the refrigerant piping and the nature of the equipment used in the system. Because of the need to take these factors into consideration, the efficiency of a system and the operating ability of the system, such as the ability to unload can be compromised.

Most refrigeration and air conditioning systems currently use a refrigerant R12 or a singular refrigerant which is a CFC or HCFC refrigerant which is potentially damaging to the environment. Other refrigerants in use include R22, which is currently approved for use under the Montreal Protocol on the ozone layer until 2030 A.D. However, use of this refrigerant must be in progressively reducing volumes and the only CFC-free commercial refrigerant currently endorsed without reservation by the Montreal Protocol and by the International Heating, Ventilation and Air Conditioning Industry (HVAC) is the refrigerant known as R134A. This refrigerant, however, is commercially unsuitable as a direct replacement for the CFC refrigerants in existing hematic or semi-hematic machines because the chemical structure of R134A results in a performance loss of up to about 30%. Further, the refrigerant R134A is basically unsuitable for use with existing compressors because the refrigerant is chemically incompatible with lubricants now available for the mechanical bearings and other rotating or reciprocating parts of the compressors.

Another difficulty with current air conditioning systems is that, traditionally, small to medium refrigeration systems of between 1 and 150 kilowatts use reciprocating, rotary or scroll compressors which are relatively cheap to produce but are relatively inefficient. Screw compressors become more efficient at sizes between 150 and 1,000 kilowatts although most systems over 500 kilowatts use centrifugal compressors. These are more efficient than screw compressors, but are conventionally far more costly to produce and maintain.

The efficiencies of the smaller equipment, below 180 kilowatts, is restricted by the available technology in the reciprocating, rotary, scroll and screw compressors. While centrifugal machines can offer a higher efficiency in the lower capacity range, limitations on high rotational speed drives, and the cost thereof, inhibits their use.

BACKGROUND ART

WIPO Publication No. WO 91/17361 discloses an oilless centrifugal compressor for use in pharmaceutical, food and like industries and which is characterized by axially directed journalling being effected by means of a magnetic bearing assembly which is controlled from an element measuring the axial position of the rotating components. However, the disclosure in this specification does not take account of particular difficulties associated with refrigeration compressors in air conditioning systems where variable loads and variables such as refrigerant temperature and pressure require variations in compressor operating parameters without compromising efficiency.

It is therefore desirable to provide an improved construction of compressor which is able to be used with the advanced refrigerants, including R134A, and which avoids disadvantages of the current compressors using lubricating oil or similar lubricants.

It is also desirable to provide a compressor which is able to operate at very high efficiencies over a wide range of load.

It is also desirable to provide a control system for a high speed compressor which is able to match compressor operation with load requirements.

It is also desirable to provide a compressor for air conditioning or refrigeration systems which is able to be manufactured relatively simply and economically in a variety of capacities.

According to one aspect of the invention there is provided a refrigeration compressor having one or more compression stages and comprising an electric motor having a rotor mounted on a shaft supported by oilless bearings, at least a first stage gas impeller carried by the shaft, a housing for the motor and impeller, said housing incorporating an axially extending gas inlet having gas throttling means to control the supply of refrigerant gas to the impeller, the housing defining a chamber to receive gas, a gas discharge extending from said chamber, and axial locating means acting an said shaft to counter axial loading resulting from at least one stage gas compression.

Preferably, said compressor is a two stage compressor and said axial locating means includes the second stage mounted on the other end of said shaft to said first stage impeller whereby the axial forces generated by said two stages substantially balance each other.

The oilless bearings supporting said shaft with the rotor and impellers may comprise magnetic radial bearings and preferably includes at least one axial bearing, or thrust bearing, to take account of axial loads not balanced by the two compressor stages.

The magnetic bearings may be either active radial and axial bearings, passive radial and axial bearings or a combination of active and passive bearings. Where active bearings are used, a touch down bearing of ceramic or other material is provided to support the shaft while stationary and without power.

In an alternative form, the oilless bearings may comprise foil gas bearings which utilize a wedge of gas, in this case, refrigerant gas, to separate the surface of the shaft from a thin bearing foil which is supported for movement within a casing. The foil gas bearings may be made from Inconel, beryllium copper, or various steels. The bearings use the flexible foil surface to maintain a film of gas between the rotating shaft and the stationary bearing parts. The load capacity of such bearings increases with speed and such bearings are ideally suited to high speed electric motors. Because the compressor of the invention is substantially hermetically sealed, the internal atmosphere within the compressor housing is refrigerant gas which provides the required gas for the bearing.

Preferably, the electric motor is a brushless DC motor having a rare earth rotor which offers very high electrical efficiencies and the rotor is able to rotate at extremely high speeds, i.e. between 30,000 and 80,000 RPM, or greater. Other types of electric motors may be used in the present invention including a short-circuit machine or a permanently magnetized synchronous machine While such motors are known, and will not be described in greater detail, they have not been used in driving a refrigeration compressor in the manner proposed in the present invention.

In a preferred form of the invention, the outer housing is a pressure die-cast casing of aluminium alloy or other suitable metal or synthetic plastic material. The casing may be formed of two or more sections which are able to be clipped or locked together without the need for conventional fasteners such as screws or the like. Such a casing structure enables quick and easy assembling yet provides a secure and rigid casing structure.

The inner housing parts, guide vane assemblies, labyrinths, and other internal parts of the motor and compressor may preferably be formed of a synthetic plastics material such as the material known under the trade mark "ULTEMP" made by General Electric Company. This plastics material is a stable, high temperature plastics which is able to withstand temperatures of up to 450° C. and is substantially impervious to refrigerants. Being non-magnetic, the plastics material is imminently suitable in a compressor utilizing magnetic bearings.

It is envisaged that a compressor of the present invention will be made of a capacity up to 350 kW and versions of lower capacity, i.e. down to, for example, 10 kW will utilize most of the parts of the larger capacity compressor, including the inner and outer casings, guide vane housing, gas distribution ducting and the like. The lower capacity of the compressors will be accomplished by reducing the motor power, by reducing laminations, by varying the impellers used and by varying the gas inlets to the two compressor stages.

In order that the invention will be more readily understood an embodiment thereof will now be described with reference to the accompanying drawings wherein.

Figure 6A:
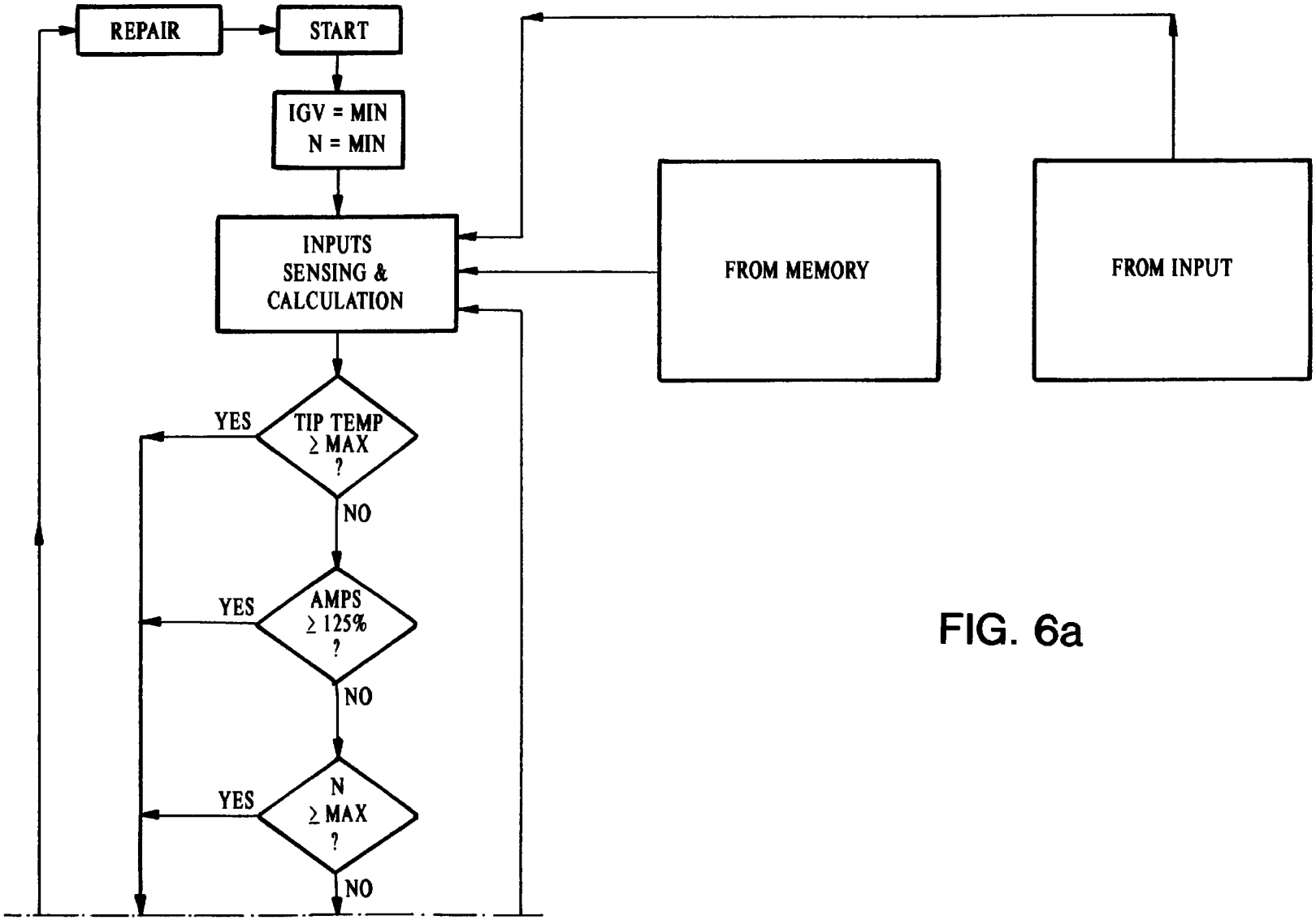

FIGS. 6*a,* 6*b* & 6*c* together comprise a control logic diagram for operating the compressor of the invention.

Referring to the drawings, a refrigeration compressor in accordance with the invention comprises an inner housing 12 formed of an injection molded synthetic plastics material which is stable and resistant to high temperature. This material may be glass filled for strength. An outer housing 13 is formed of two pressure die-cast casings of aluminium alloy or other rigid material secured together to define the housing and integral gas passages 14 and 16. In this embodiment, the gas passage 14 extends from a first stage compressor 17 at one end to the second stage compressor 18 at the other end of the compressor. The gas passage 16 comprises the outlet from the second stage.

The first and second stage impellers are mounted on opposite ends of a drive shaft 22 mounted for rotation in a pair of radial magnetic bearings 23 and 24. The shaft is driven by a brushless DC permanent magnet motor, and an axial electromagnetic bearing 26 is provided to counteract axial loadings on the shaft 22.

The electric motor 27 has the stator 28 carried by the inner housing 12 while the rotor 29 is carried by the shaft 22. The rotor 29 is formed with laminations of a rare earth material as known in the art, such as neodymium iron boride, providing extremely high electrical efficiency and permitting very high speeds to be developed by the motor. An electric motor of this type is capable of speeds of up to 80,000 rpm, and more and because of the high rotational speeds the efficiency of the compressor is also high over a range of compressor loads.

The radial magnetic bearings 23 and 24 may be of the passive type utilizing permanent magnet technology. Alternatively, the radial bearings 23 and 24 may be active magnetic bearings in which case control circuitry therefor will be incorporated into the compressor. Such control circuitry, which is known in the art and will not be described in detail, may take the form of three dimensional printed circuit boards formed integral with the casing 12, with sensors located on the fixed and rotational parts of the bearings to permit active control thereof Such control circuitry determines the location of the rotational bearing part relative to the fixed part at a given time and produces error signals which are used to make magnetic adjustments as required to correct any deviation at any given angular position. Similarly, the active axial magnetic bearing 26 is provided with control circuitry to maintain predetermined clearances between adjacent axially spaced bearing surfaces. Compressor control system 30 incorporates power supply means in order to supply electrical power to the active magnetic bearings in the event that a system power outage occurs during operation of the compressor. Such power supply means may involve the use of the electric motor as a generator if power supply to the motor is cut or to use the bearing itself to generate a self-sustaining power supply. Ceramic touch down bearings may be provided to take bearing loads when the shaft 22 is stationary following a loss of electrical power to the motor and magnetic bearings.

It will be understood that the two stage compressor enables axial loading on the motor shaft to be substantially balanced thus allowing the use of an axial magnetic bearing of minimal size and power.

The inner housing 12 also forms the gas inlet chamber 31 which houses adjustable guide vanes 34 which throttle the gas flow to the first stage impeller 19. In a low load condition, the guide vanes 34 will be moved to reduce the gas flow whereas in a high load condition the guide vanes 34 will be opened to allow an increase in the gas flow to the first stage compressor 17. In the embodiment illustrated, a number of guide vanes 34 extend radially inwardly from the inlet end of the housing 12, each vane being rotatable about a radially extending axis. Each vane has a cam 37 and a finger 36 extending from the cam 37 engages in a corresponding slot in control ring 38 carried by the housing 12. With this arrangement, rotation of the control ring 38 causes movement of the cams 37 about their respective axis thus causing rotation of the guide vanes 34. The control ring 38 may be rotated by a linear motor or the like (not shown).

The refrigerant gas, after passing the first stage impeller 19 passes through the gas passage 14 to the inlet of the second stage compressor 18. The second gas inlet may or may not be provided with guide vanes, depending on the compressor size and the degree of control which is necessary. The compressor refrigerant gas passing the second stage compressor 18 exits through the outlet passageway 16 past a check valve 32.

The stator 28 of the electric motor 27 defines with the housing 12 a motor cooling duct 39. This duct can be provided either with liquid refrigerant bled from the refrigerant circuit or with gaseous refrigerant by-passing either the second stage or both stages of the compressor. By using refrigerant as the cooling medium, motor heat is able to be dissipated in the condenser of the refrigeration circuit thus providing an efficient heat transfer system.

Figure 2:
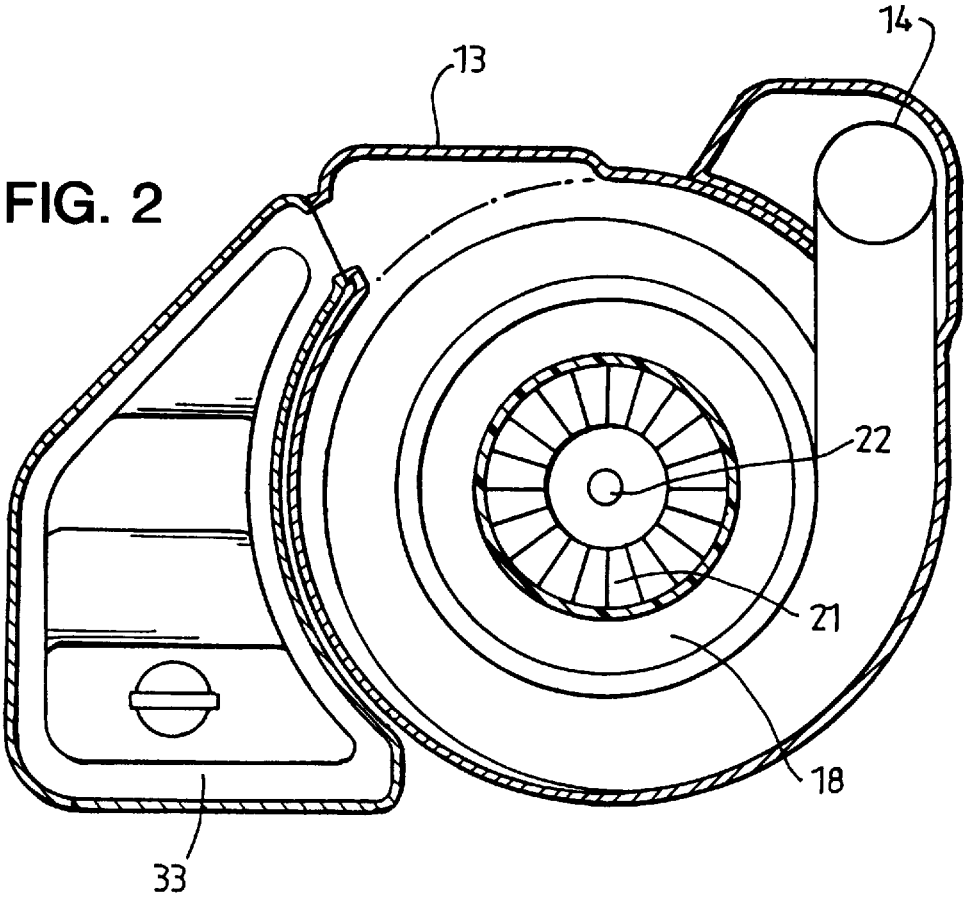
FIG. 2 is a cross-sectional view taken along the lines A—A of FIG. 1.
Figure 3:
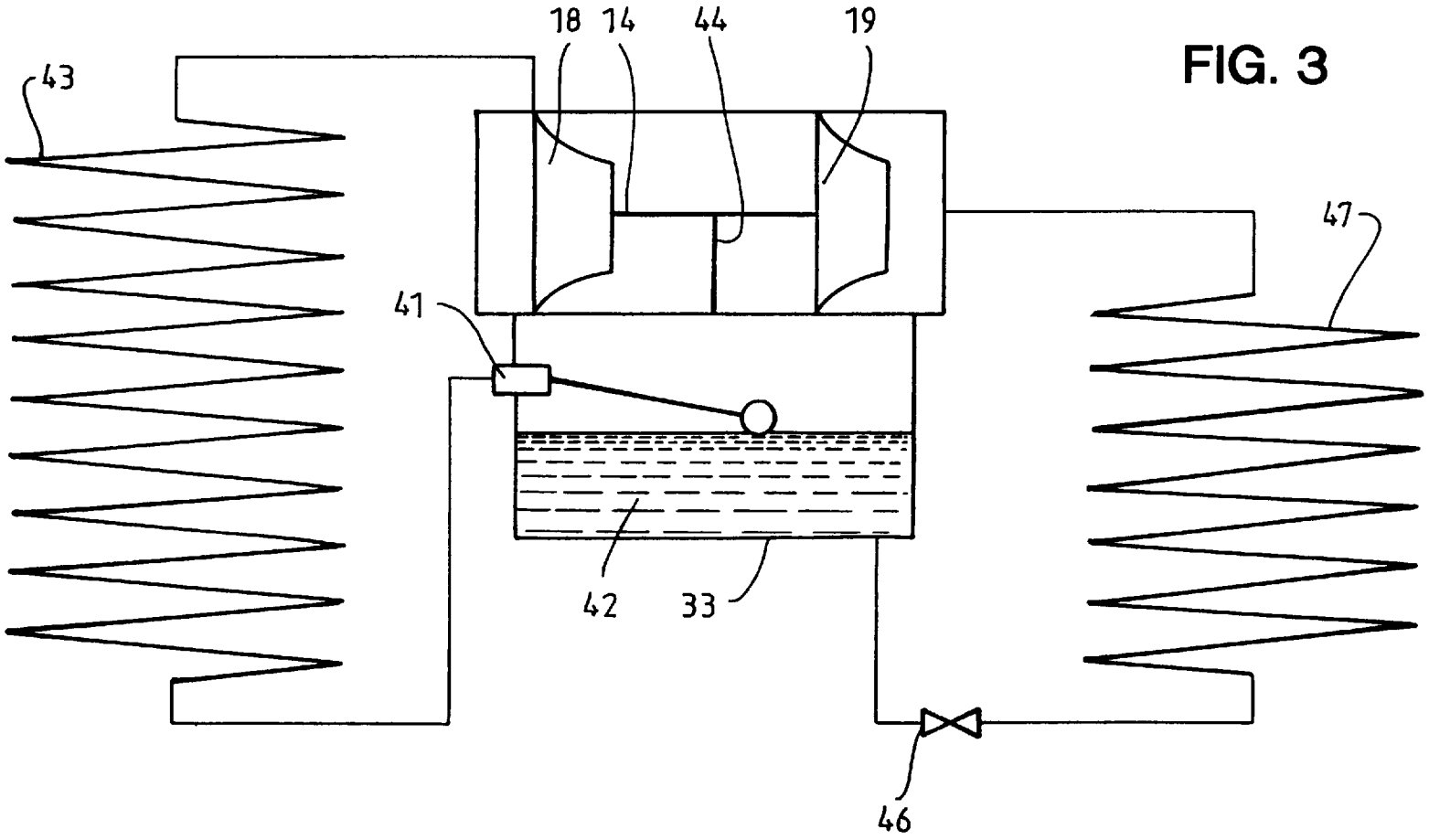
FIG. 3 is a schematic refrigerant circuit diagram for a compressor of the present invention.

Referring to FIGS. 2 and 3, the compressor of the invention is preferably provided with an expansion chamber 33 which is conveniently formed integral with the outer casing 13. The expansion chamber 33 is provided with a flow valve 41 which governs the entry of liquid refrigerant 42 into the chamber 33. Most of the refrigerant from the refrigeration circuit condenser 43 is in liquid form. However, a small amount of gas that cools down the rest of the liquid is allowed to flash off as the refrigerant enters the expansion chamber 33 through the valve 41.

The refrigerant gas in the expansion chamber 33 passes through a port 44 into the passageway 14 between the first and second stage compressors 17 and 18. It will be understood that, in the refrigerant circuit, the gas in the condenser portion of the circuit is at a relatively high pressure, the gas in the expansion chamber 33 and in the passageway 14 is at a medium pressure while the liquid and gas in the evaporator 47, downstream from the expansion valve 46, is at a relatively low pressure.

The flow valve 41 operates in accordance with the load demand on the refrigerant system. As load increases and more refrigerant is drawn through the evaporator, the flow valve opens to admit greater amounts of liquid into the expansion chamber 33. As load decreases, the flow valve operates to restrict the amount of liquid refrigerant 42 entering the expansion chamber 33. Any refrigerant which does enter, however, and is flashed off passes directly to the passage 14.

The compressor of this invention is provided with pressure transducers in the outlet passage 16 and the gas inlet chamber 31. The pressure transducer 20 in the outlet passage 16 and transducer 25 in the inlet chamber 31 are used to control the speed of the motor 27 through the control circuit 30 using a control logic as hereinafter described so that the tip speed pressure of the second stage impeller 21 is only slightly above the condensing pressure in the system condenser and the operating point of the compressor is maintained above the surge point.

The pressure transducer 25 in the inlet chamber 31 is used to provide one form of control for the guide vanes 34 to thereby control the amount of gas passing through the compressor and to provide a constant suction pressure according to the load. As indicated previously, as the load reduces, the vanes or speed reduction reduce the amount of gas flowing into the first stage 17.

Figure 4:
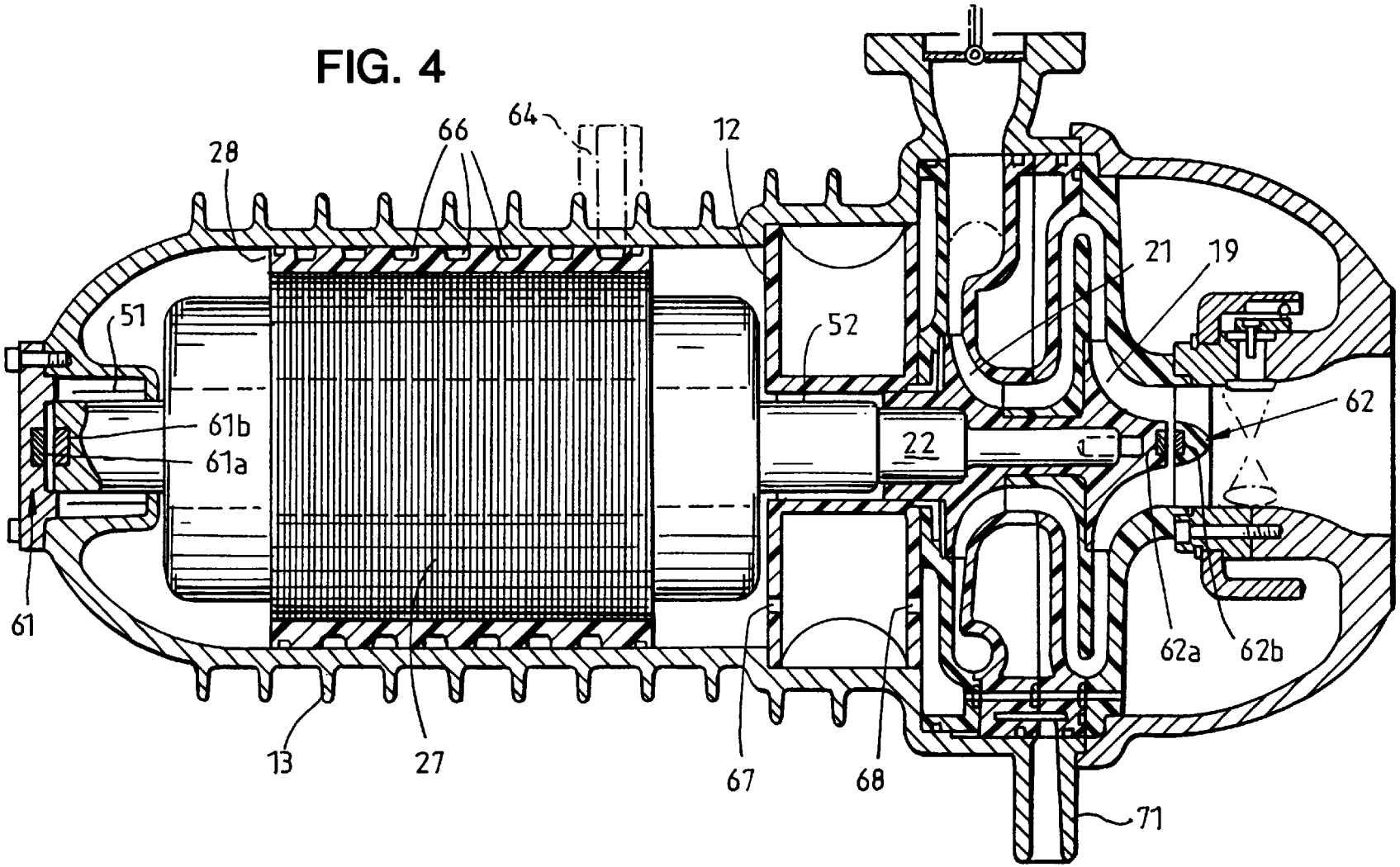
FIG. 4 is a cross-sectional view of a modified form of compressor in accordance with a second embodiment of the invention.

Referring to FIG. 4 there is illustrated a second embodiment of the invention in which the two compressor stages are back-to-back, the first stage impeller 19 and second stage impeller 21 both being mounted on one end of the motor shaft 22.

Figure 5:
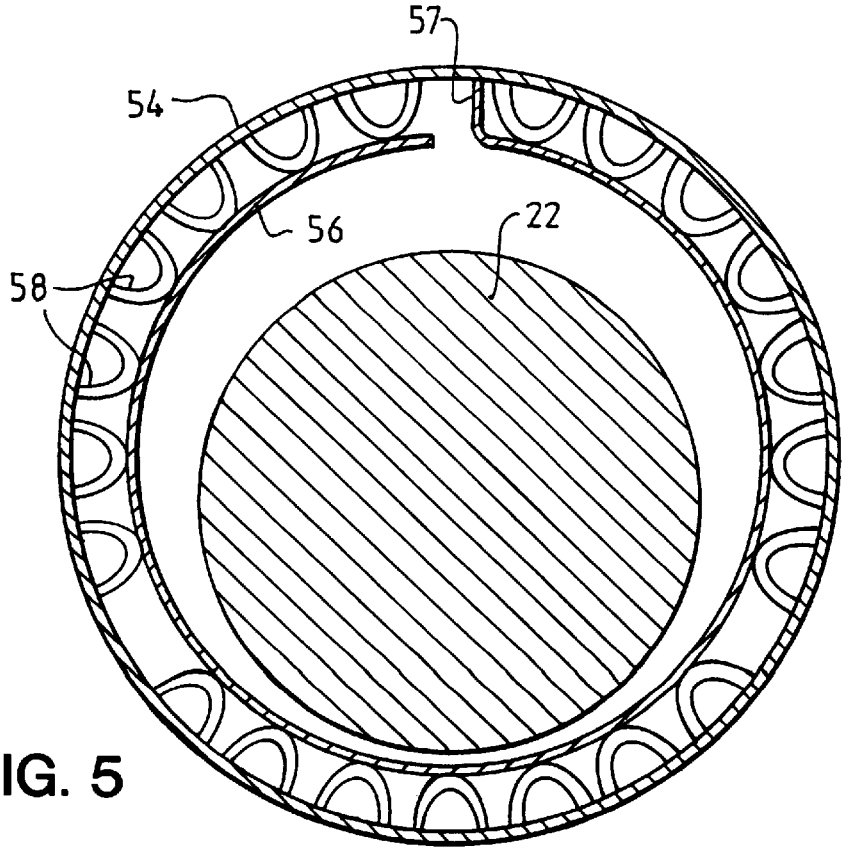
FIG. 5 is a cross-sectional view of a foil gas bearing used in a compressor of the present invention.

In this embodiment, the electric motor 27 is mounted for rotation on a pair of foil gas bearings 51 and 52. The foil bearings 51 and 52, which are known in the art, may take several different forms. In one form as illustrated in FIG. 5, the bearing comprises an outer casing 54, all inner, smooth top foil 56 fixed at one end 57 within the cylindrical casing 54, and a series of deformable foils 58 between the top foil 56 and the casing 54. In operation, rotation of the shaft 22 draws in gas between the shaft 22 and the top foil 56. The gas forms into the shape of a wedge thereby supporting the shaft 22 on the foil 56.

In the present invention, the gas is refrigeration gas which surrounds the motor as hereinafter described.

Axial movement of the shaft 22 relative to the casing 13 is controlled by a pair of magnetic thrust bearings 61 and 62 at opposite ends of the shaft 22. Each thrust bearing 61, 62 comprises a pair of button magnets 61*a*, 61*b*, 62*a* and 62*b*, respectively, set into the respective ends of the shaft and the supporting casing. The associated button magnets are spaced a predetermined distance with like poles adjacent whereby the repelling forces maintain the shaft substantially centrally located. With current magnet technology, repelling forces of up to approximately 60 pound per square inch are obtained across a spacing of 10 thousandths of an inch.

Alternatively, the permanent magnet thrust bearing may be replaced by an active magnetic thrust bearing using appropriate control circuitry as previously described with reference to the first embodiment, or using axial foil gas bearings similar to the radial foil bearings 51 and 52 previously described.

The electric motor 27 of this embodiment is cooled with liquid refrigerant which enters the casing 13 through inlet pipe 64. The liquid refrigerant is preferably drawn from the expansion chamber 33 or drawn from the high pressure side of the refrigerant circuit and, if necessary, passed through a throttling device such as a valve, orifice or capillary.

The liquid refrigerant passes around spiral grooves 66 in the motor stator 28 and into the end of the rotor through passage therein (not shown). The heated and gasified refrigerant finally passes from the motor housing through holes 67 and 68 and passage 69 and passes into the suction inlet 31 on the downstream side of the guide vanes 34.

In this embodiment of the invention, refrigerant gas from the expansion chamber 33 is introduced between the two compression stages through inlet pipe 71.

A major advantage of the compressor of the present invention is the ability to construct compressors of various capacities ranging from, for example, 10 kW to 100 kW, using a substantial part of the componentry which is common to all compressors. Thus, the casings, housings, bearings and the like can be common to all compressors and the only changes which need to be made to vary the capacities are to the motor size and power and the design of impellers, guide vanes and the like.

Figure 1:
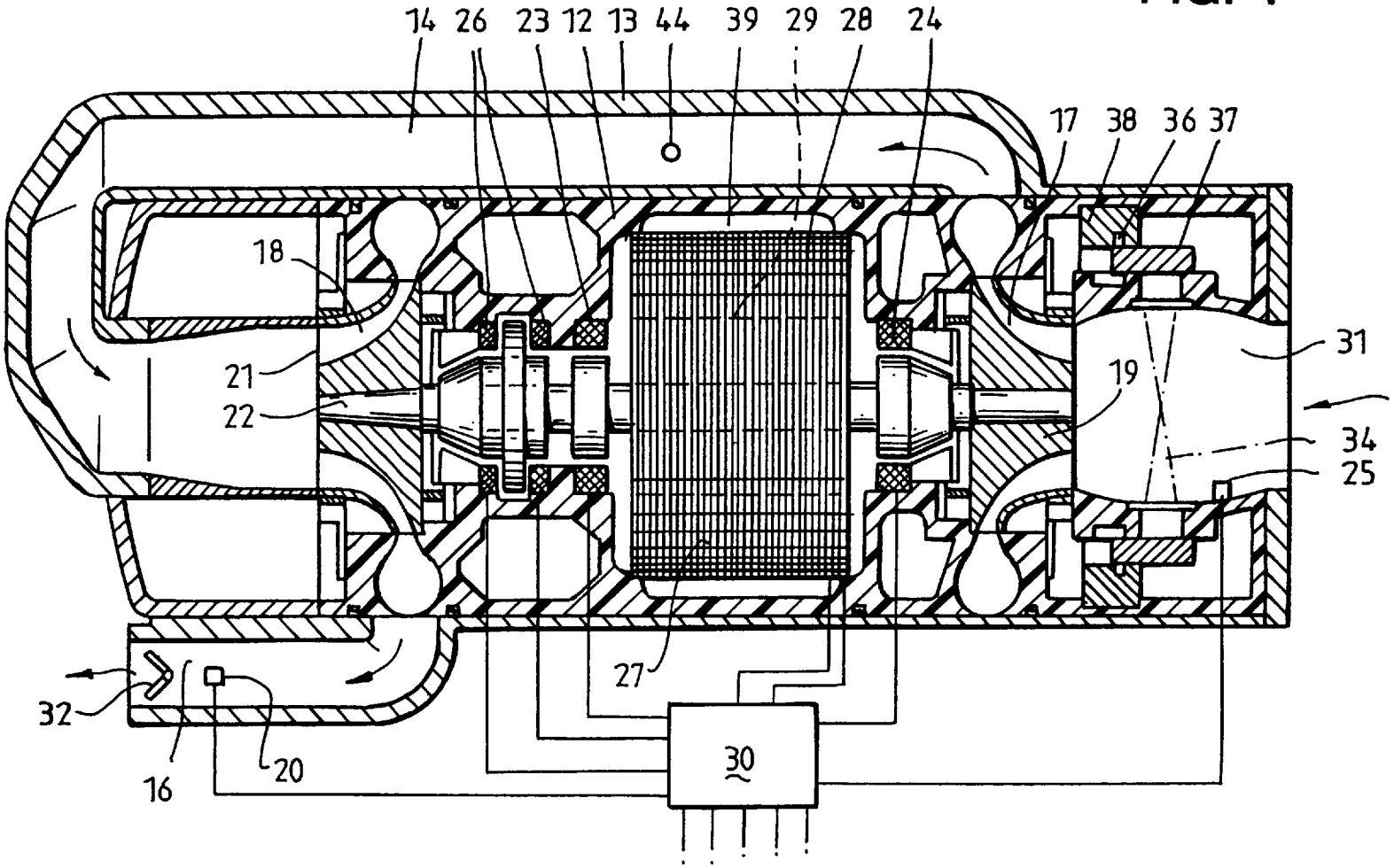
FIG. 1 is a cross-sectional view of a compressor in accordance with one embodiment of the invention.
Figure 6B:
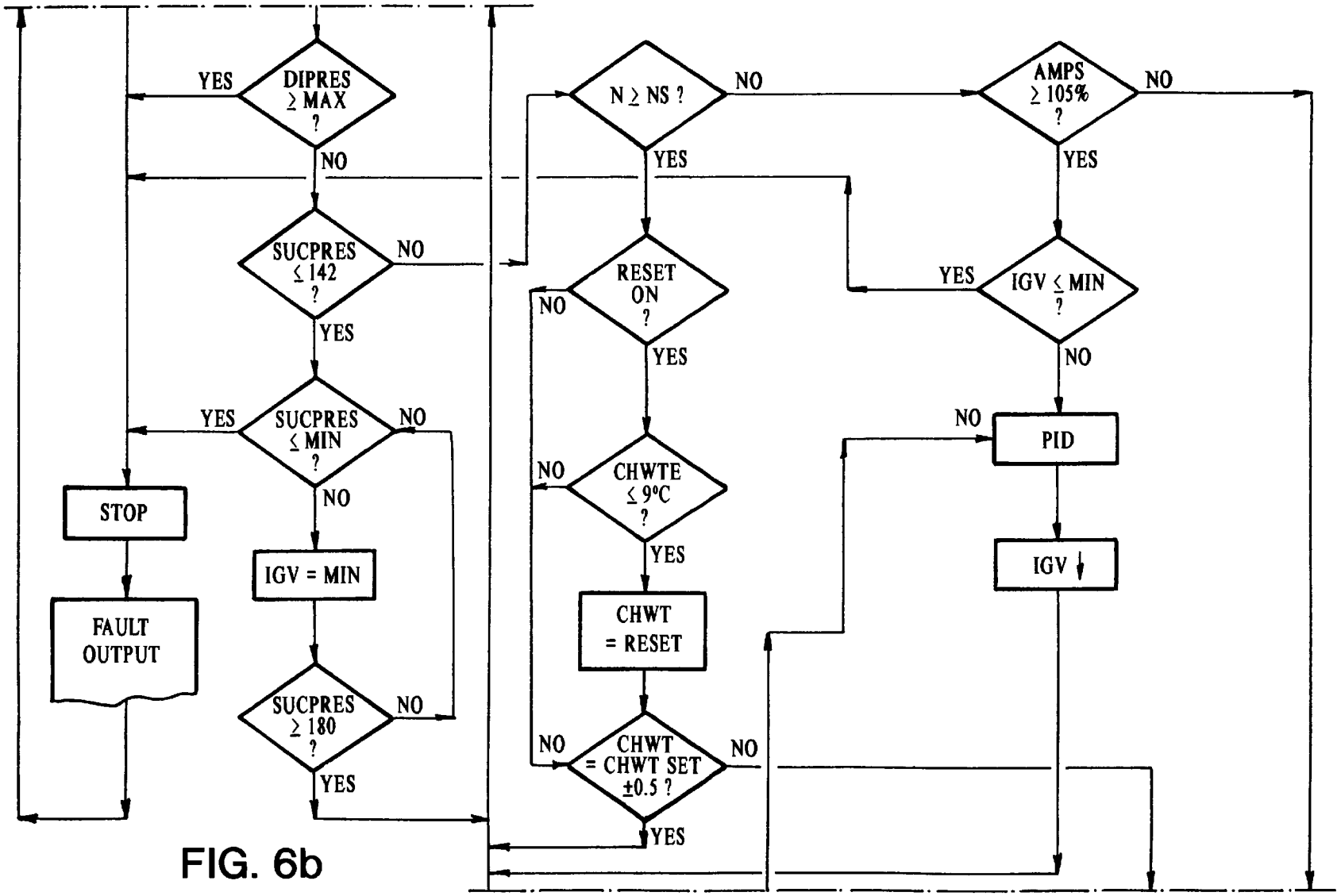
Figure 6C:
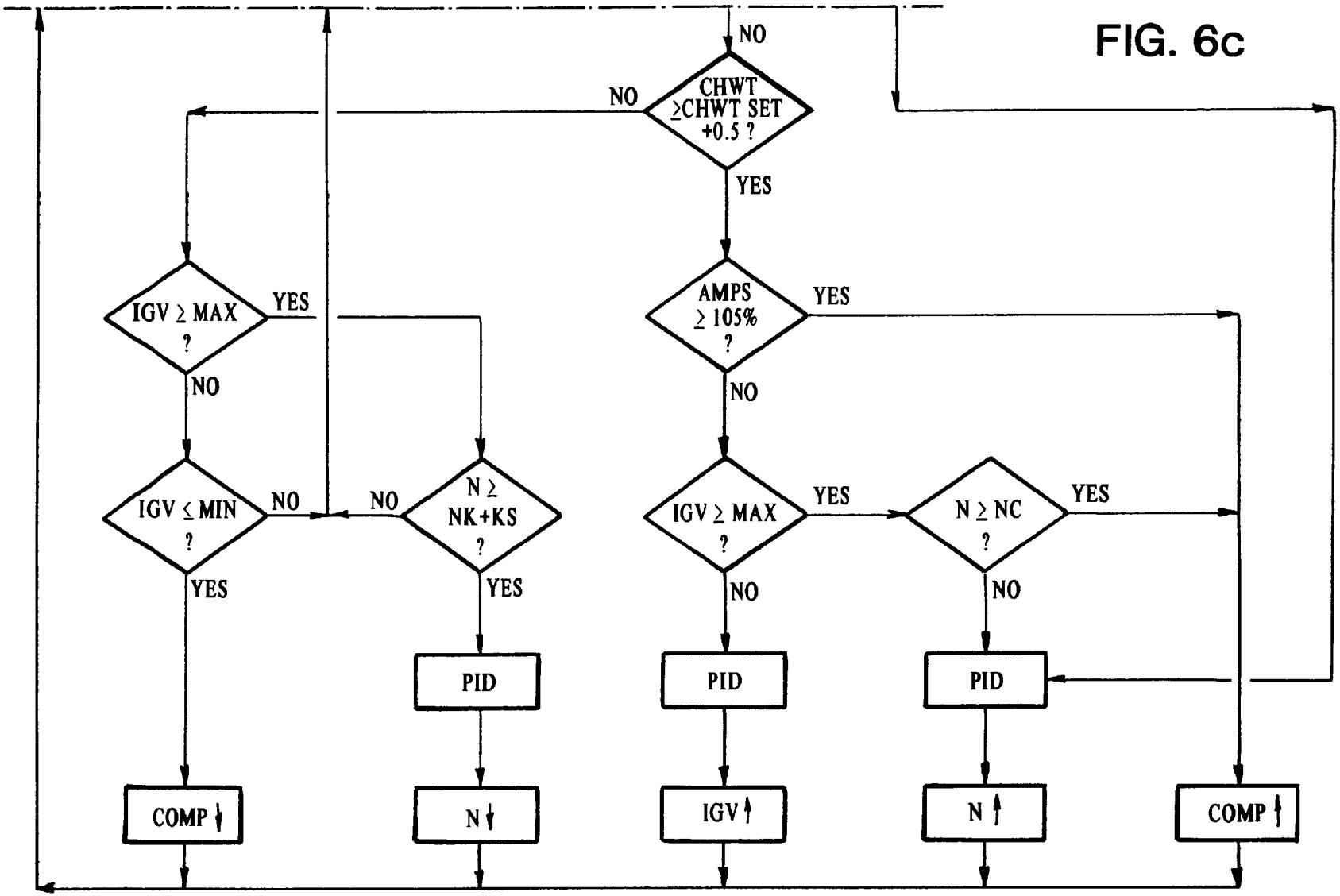

A further feature of the present invention is the control system and control logic used to control compressor operation. Referring to FIG. 6, there is shown an example of a control logic devised for control of a compressor and associated compressors of the invention. Table 1 lists the legend of abbreviations used in the example logic diagram and lists those parameters for compressor operation which are either stored in a computer memory, which is part of the control system 30 (see FIG. 1), or are input from various sensors on the compressor and refrigeration circuit. These sensors provide signals to the control system 30 in respect of chilled water entering temperature, which is the temperature of water entering the evaporator in an air conditioning system, motor rotational speed, suction pressure, as measured by the pressure transducer 25, impeller tip temperature, discharge pressure as measured by pressure transducer 20, chilled water temperature leaving the evaporator, motor current and inlet guide vane position.

parameters. Several parameters such as impeller tip temperature and motor current give rise to fault indications so that the system can shut-off in the case of a developed fault.

The compressor of the present invention is particularly suitable for use in a modular refrigeration system in which a plurality of substantially identical, modular refrigeration units are assembled together to form the air conditioning system. The control logic of the present invention provides for the starting or stopping of additional compressors in such a modular system subject to the detected load conditions.

The compressor of the present invention, by using oilless bearing technology, such as magnetic or foil bearings, is able to be used with advanced refrigerants such as R134A refrigerant. The bearing technology also permits very high rotational speeds which substantially improve the operating efficiencies of the compressor as compared with standard centrifugal compressors.

TABLE 1

CONTROL SYSTEM LOGIC

| FROM MEMORY | FROM INPUT | | LEGEND |
|---|---|---|---|
| $Pr = \frac{(DISPRES + 101.3)}{(SUCPRES + 101.3)}$ | CHWTE | N: | Motor Rotational Speed |
| $CHWT_{SET} = 7°$ C. | N | SUCPRES: | Suction Pressure (Gauge) |
| | | DISPRES: | Discharge Pressure (Gauge) |
| 100% AMPS = 200A | SUCTEMP | AMPS: | Motor Power Line Current |
| MAX. N = 60 KRPM | SUCPRES | SUCTEMP: | Suction Line Temperature |
| MAX. TIPTEMP = 75° C. | TIPTEMP | PID: | Proportion Integral and Divitive Control |
| NX = NS(Pr.IGV) | DISPRES | TIPTEMP: | Impeller Tip Temperature |
| NC = NC(Pr.IGV) | CHWT | CHWT: | Chilled Water Leaving Temperature (can be replaced by SUCPRES) |
| MAX.IGV = 0° C. | AMPS | CHWTE: | Chilled Water Entering Temperature |
| MIN.N = 25 KRPM | IGV | IGV: | Inlet Guide Vane Position |
| PID SETTING | | Pr: | Pressure Ratio |
| RESET = 9° C. | | NS: | Min. Speed before Surge |
| RESET = ON | | NC: | Max. Speed before Choke |
| | | COMP↓: | Turn off Another Compressor |
| | | COMP↑: | Turn on Another Compressor |
| | | IGV↓: | Throttling of Inlet Guide Vane |
| | | IGV↑: | Opening of Inlet Guide Vane |
| | | N↓: | Decrease of Rotational Speed |
| | | N↑: | Increase of Rotational Speed |
| | | Ks: | Speed Constant (e.g. 2kPRM) |
| | | ≦ | Equal to or less than |
| | | ≧ | Equal to or greater than |

When the input signals are received at the input-box 103, the control logic checks the variables as indicated and subject to the variables being within predetermined limits, the motor speed is increased which produces an increase in compression ratio (calculated from the discharge pressure and suction pressure) and/or mass flow.

The load on the system is indicated by the chilled water entering and leaving temperatures. The control system constantly monitors those temperatures and varies the inlet guide vane position and the motor speed to maintain those temperatures between predetermined limits. In one example, the desired chilled water leaving temperature may be set at 7° C. which can be reset to a high temperature (9° C. in this example) for energy saving purposes when the chilled water entering temperature reduces to a predetermined value (9° C. in this example) if the option of resetting the chilled water leaving temperature is selected.

As the system load varies, such variations are detected at the input 103 and the control logic adjusts inlet guide vane position and motor speed lo maintain the preset desired The inner housing 12, motor cooling ducting, labyrinths and other internal structural components may be injection molded using the General Electric "ULTEMP" plastics material or other glass filled composite materials which have extreme rigidity, are impervious to chemical attack, are electric non-conductors and are highly heat resistant. Such a structure will have the necessary strength for longevity but will enable the compressor to be manufactured of a size substantially less than that of compressors of equivalent capacity. Thus, a compressor in accordance with the present invention may be less than one half the size, in overall terms, and one third the weight of an equivalent known compressor. The outer housing 13 is preferably cast aluminium alloy.

I claim:

1. A compressor for compressing a refrigerant having liquid and gaseous phases, comprising:

at least one centrifugal compressor stage having an impeller mounted on a shaft, the shaft being supported by oilless radial bearings:

an electric motor for driving the shaft, the motor including a rotor connected to the shaft;

axial locating means associated with the shaft to restrict axial movement thereof;

a housing enclosing the motor and said at least one impeller, said housing incorporating an axially extending gas inlet and a gas outlet passage;

gas throttling means in the inlet to control the supply of gas to the impeller, passageways in the housing to convey liquid refrigerant to cool the motor and to convey refrigerant gas from the motor to the gas inlet; and control means to control the gas throttling means in response to a refrigeration load, said control means adapted to generate control signals based on said load, said throttling means responsive to said control signals.

2. A compressor according to claim 1 wherein a second centrifugal compressor stage receives gas from the first stage and includes a second impeller mounted on the shaft.

3. A compressor according to claim 1 wherein said motor is located between said first and second compressor stages and said housing incorporates a duct to convey gas from an outlet of said first stage to an axially disposed inlet of said second stage.

4. A compressor according to claim 3 wherein a gas port conveys refrigerant gas from a refrigerant expansion chamber to the second compressor stage.

5. A compressor according to claim 3 wherein a gas port conveys refrigerant gas from a refrigerant expansion chamber to the second compressor stage.

6. A compressor according to claim 5 wherein said expansion chamber is integral with the housing and includes a liquid refrigerant level sensor and valve to control the refrigerant flow into the chamber in accordance with load.

7. A compressor according to claim 2 wherein said motor is located between said first and second compressor stages and said housing incorporates a duct to convey gas from an outlet of said first stage to an axially disposed inlet of said second stage.

8. A compressor according to claim 1 wherein said axial locating means comprises an active axial magnetic thrust bearing.

9. A compressor according to claim 1 wherein said axial locating means comprises a pair of passive magnetic thrust bearings each having a first permanent magnet secured to respective ends of the shaft and a second permanent magnet secured to the housing adjacent the respective first magnets, the magnets of each pair having like poles adjacent to repel each other thereby centering the shaft between the said second magnets.

10. A compressor according to claim 1 wherein said axial locating means comprises axial foil gas bearings.

11. A compressor according to claim 1 wherein said oilless radial bearings comprise foil gas bearings.

12. A compressor according to claim 1 wherein said gas throttling means comprises a plurality of radially extending vanes in the gas inlet, each vane being rotatable between open and closed positions about a radial axis by a control ring within the housing in response to control signals from said control means.

13. A compressor according to claim 1 wherein said housing includes an inner housing formed by injection molding synthetic plastics material, the inner housing forming bearing supports, refrigerant passageways, motor stator support and gas labyrinths.

14. A compressor according to claim 13 wherein said housing includes an outer housing of die-cast aluminium alloy.

15. A refrigeration system comprising a compressor as claimed in claim 1, a refrigerant condenser to condense the refrigerant gas passing from the gas outlet passage, an expansion chamber, an expansion device and an evaporator means, and said control means receives input signals from the evaporator means, pressure transducers in the gas inlet and gas outlet passage, gas throttling means, motor power supply means and motor speed sensor means and adjusts the motor speed and gas throttling means in accordance with system load and logic control parameters to maintain predetermined refrigerant flow through the compressor.

16. A system according to claim 15 wherein said control logic is substantially as described with reference to FIGS. 6*a,* 6*b* and 6*c*.

17. A compressor according to claim 1 wherein said oilless radial bearings comprise active magnetic bearings having control circuitry to maintain a predetermined spacing between rotating and stationary bearing surfaces.

18. A compressor according to claim 1 wherein a second centrifugal compressor stage receives gas from the first stage and includes a second impeller mounted on the shaft.

19. A compressor according to claim 1 wherein said motor is located between said first and second compressor stages and said housing incorporates a duct to convey gas from an outlet of said first stage to an axially disposed inlet of said second stage.

20. A refrigeration compressor comprising:

at least one centrifugal compressor stage having an impeller mounted on a shaft;

an electric motor to drive the shaft, the motor including a rotor connected to the shaft and the shaft being supported by active magnetic bearings having control circuitry to maintain a predetermined spacing between rotating and stationary bearing surfaces;

axial locating means associated with the shaft to restrict axial movement thereof;

a housing enclosing the motor and impeller, said housing incorporating an axially extending gas inlet and a gas outlet passage;

passageways in the housing to convey refrigerant to cool the motor and to convey refrigerant gas from the motor to the gas inlet;

gas throttling means in the inlet to control the supply of gas to the impeller, said gas throttling means comprising a plurality of radially extending vanes in the gas inlet, each vane being rotatable between open and closed positions about a radial axis by a control ring within the housing in response to control signals from said control means; and control means to control the gas throttling means in response to a refrigeration load.

21. The compressor according to claim 20 wherein said axial locating means comprises an active axial magnetic thrust bearing.

22. The compressor according to claim 20 wherein said axial locating means comprises a pair of passive magnetic thrust bearings each having a first permanent magnet secured to respective ends of the shaft and a second permanent magnet secured to the housing adjacent the respective first magnets, the magnets of each pair having like poles adjacent to repel each other, thereby centering the shaft between the said second magnets.

23. The compressor according to claim 20 wherein said housing includes an inner housing formed by injection molding synthetic plastics material, the inner housing forming bearing supports, said refrigerant passageways, a motor stator support and gas labyrinths.

24. The compressor according to claim 23 wherein said housing includes an outer housing of die-cast aluminum alloy.

25. A refrigeration system comprising:

a compressor having at least one centrifugal compressor stage with an impeller mounted on a shaft;

an electric motor to drive the shaft, the motor including a rotor connected to the shaft and the shaft being supported by oilless radial bearings;

axial locating means associated with the shaft to restrict axial movement thereof;

a housing enclosing the motor and impeller, said housing incorporating an axially extending gas inlet and a gas outlet passage; gas throttling means in the inlet to control the supply of gas to the impeller;

control means to control the gas throttling means in response to load;

a refrigerant condenser to condense the refrigerant gas passing from the gas outlet passage;

an expansion chamber;

an expansion device; and an evaporator means, wherein said control means receives input signals from the evaporator means, pressure transducers in the gas inlet and gas outlet passage, gas throttling means, motor power supply means and motor speed sensor means and operates to adjust the motor speed and gas throttling means in accordance with system load and logic control parameters to maintain predetermined refrigerant flow through the compressor.

26. The system according to claim 25 wherein said housing incorporates passageways to convey refrigerant to cool the motor and to convey refrigerant gas from the motor to the gas inlet.

27. The system according to claim 25 wherein a second centrifugal compressor stage receives gas from the first stage and includes a second impeller mounted on the shaft.

28. The compressor according to claim 25 wherein said motor is located between said first and second compressor stages and said housing incorporates a duct to convey gas from an outlet of said first stage to an axially disposed inlet of said second stage.

29. The compressor according to claim 27 wherein a gas port conveys refrigerant gas from a refrigerant expansion chamber to the second compressor stage.

30. The compressor according to claim 29 wherein said expansion chamber is integral with the housing and includes a liquid refrigerant level sensor and valve to control the refrigerant flow into the chamber in accordance with load.

31. The system according to claim 25 wherein said control logic uses input data from said input signals and from pre-programed memory and determines motor speed and gas throttling to maintain predetermined operating parameters.

* * * * *

US005857348C1

(12) EX PARTE REEXAMINATION CERTIFICATE (9168th)

United States Patent
Conry

(10) Number: US 5,857,348 C1
(45) Certificate Issued: Aug. 7, 2012

(54) COMPRESSOR

(75) Inventor: Ronald David Conry, Melbourne (AU)

(73) Assignee: Danfoss Turbocor Compressors B.V., Amsterdam (NL)

Reexamination Request:
No. 90/011,078, Jul. 1, 2010

Reexamination Certificate for:

| | |
|---|---|
| Patent No.: | **5,857,348** |
| Issued: | **Jun. 12, 1999** |
| Appl. No.: | **08/578,563** |
| Filed: | **Mar. 8, 1996** |

(22) PCT Filed: Jun. 14, 1994

(86) PCT No.: PCT/AU94/00319

§ 371 (c)(1),
(2), (4) Date: Mar. 8, 1996

(87) PCT Pub. No.: WO94/29597

PCT Pub. Date: Dec. 22, 1994

(30) Foreign Application Priority Data

Jun. 15, 1993 (AU) ..... PL9394

(51) Int. Cl.
*F25B 41/04* (2006.01)
*F04B 17/00* (2006.01)

(52) U.S. Cl. ..... 62/209; 62/217; 62/228.5; 62/508; 417/423.12

(58) Field of Classification Search ..... 62/505
See application file for complete search history.

(56) References Cited

To view the complete listing of prior art documents cited during the proceeding for Reexamination Control Number 90/011,078, please refer to the USPTO's public Patent Application Information Retrieval (PAIR) system under the Display References tab.

*Primary Examiner*—William Doerrler

(57) ABSTRACT

A centrifugal type refrigerant compressor comprises at least one impeller (17, 18), electric motor (27) and drive shaft (22) mounted on non-lubricated radial bearings, such as magnetic or foil gas bearings (23, 24), with axial locating means (26) associated with the shaft (22) to restrict axial movement thereof with respect to the compressor housing (12). The housing (12) encases the motor (27) and the compressor and defines the gas inlet (31) and the gas outlet (16) passageways. Gas throttling means (34) is provided in the inlet (31), and a control means (30) varies the speed of the motor (27) and the throttling means (34) to control the compression ratio and mass flow through the compressor in accordance with the refrigeration load.

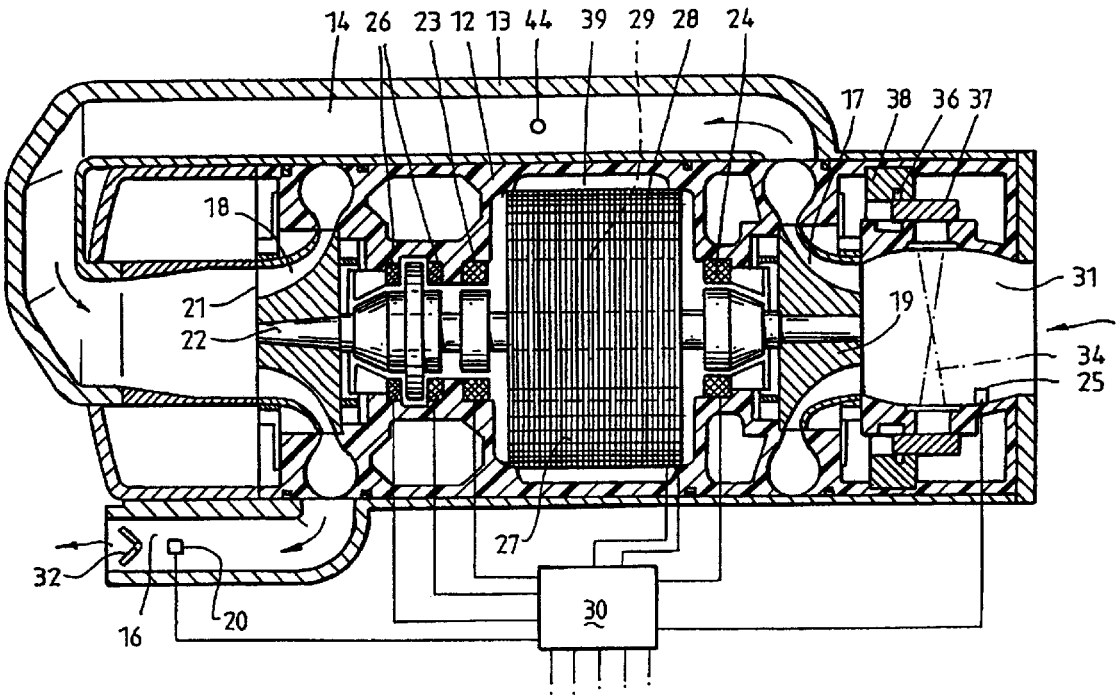

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, 8, 12-14, 17, 20, 21, 23 and 24 is confirmed.

Claims 2-7, 9-11, 15, 16, 18, 19, 22 and 25-31 were not reexamined.

* * * * *